US008362983B2

(12) United States Patent
Kwak et al.

(10) Patent No.: US 8,362,983 B2
(45) Date of Patent: Jan. 29, 2013

(54) ORGANIC LIGHT EMITTING DISPLAY AND MANUFACTURING METHOD THEREOF

(75) Inventors: Won-kyu Kwak, Suwon (KR); Hae-jin Chun, Suwon (KR); Ki-myeong Eom, Suwon (KR)

(73) Assignee: Samsung Display Co., Ltd., Yongin-si (KR)

( * ) Notice: Subject to any disclaimer, the term of this patent is extended or adjusted under 35 U.S.C. 154(b) by 1317 days.

(21) Appl. No.: 12/107,164

(22) Filed: Apr. 22, 2008

(65) Prior Publication Data

US 2009/0009496 A1 Jan. 8, 2009

(30) Foreign Application Priority Data

Jul. 4, 2007 (KR) ..... 10-2007-0067076

(51) Int. Cl.
*G09G 3/30* (2006.01)

(52) U.S. Cl. ..... 345/80; 345/82; 345/205; 345/76; 313/498; 313/506; 313/483; 257/59; 257/72; 315/169.3

(58) Field of Classification Search ..... 345/44–45, 345/55, 76, 77, 80, 92, 204, 205, 82; 315/169.3, 315/506; 313/498, 506, 448, 483; 257/59, 257/72
See application file for complete search history.

(56) References Cited

U.S. PATENT DOCUMENTS

| | | | | |
|---|---|---|---|---|
| 6,433,486 | B1 * | 8/2002 | Yokoyama | 315/169.3 |
| 6,919,871 | B2 * | 7/2005 | Kwon | 345/92 |
| 2007/0103406 | A1 | 5/2007 | Kim | |

FOREIGN PATENT DOCUMENTS

| | | | |
|---|---|---|---|
| JP | 8-248439 | | 9/1996 |
| KR | 1999-012260 | A | 2/1999 |
| KR | 10-2005-0041088 | A | 5/2005 |
| KR | 10-2006-0000362 | A | 1/2006 |
| KR | 10-2006-0010988 | A | 2/2006 |
| KR | 10-2006-0134405 | A | 12/2006 |
| KR | 10-2007-0002640 | | 1/2007 |

OTHER PUBLICATIONS

Patent Abstracts of Japan, Publication No. 08-248439; Date of Publication: Sep. 27, 1996; in the name of Ikuhiro Yamaguchi.

Korean Patent Abstracts, Publication No. 1020070002640 A; Date of Publication: Jan. 5, 2007; in the name of Tae Joon Ahn, et al.

(Continued)

*Primary Examiner* — Lun-Yi Lao
*Assistant Examiner* — Shaheda Abdin
(74) *Attorney, Agent, or Firm* — Christie, Parker & Hale, LLP

(57) ABSTRACT

A pixel including: an organic light emitting diode for emitting light in accordance with a received driving current; a first transistor including a gate for receiving a voltage corresponding to a data signal, the first transistor being for transferring the driving current in a direction from a source of the first transistor to a drain of the first transistor; a second transistor for transferring the data signal in accordance with a scan signal; a first capacitor for storing a voltage corresponding to the data signal and for applying the voltage corresponding to the data signal to the gate of the first transistor; and a second capacitor for controlling the voltage stored in the first capacitor, wherein an outside portion of the first capacitor has a plurality of bents.

19 Claims, 6 Drawing Sheets

OTHER PUBLICATIONS

Korean Patent Abstracts for Publication No. 1019990012260 A, published on Feb. 25, 1999 in the name of Song, Jae Hyeok.
Korean Patent Abstracts for Publication No. 1020050041088 A, published May 4, 2005 in the name of Kim, Keum Nam et al.
Korean Patent Abstracts for Publication No. 1020060000362 A, published Jan. 6, 2006 in the name of Lee, Hong Ro et al.
Korean Patent Abstracts for Publication No. 1020060010988 A, published Feb. 3, 2006 in the name of Ha, Yong Min et al.
Korean Patent Abstracts for Publication No. 1020060134405 A, published Dec. 28, 2006 in the name of Huh, Jin et al.

* cited by examiner

ORGANIC LIGHT EMITTING DISPLAY AND MANUFACTURING METHOD THEREOF

CROSS-REFERENCE TO RELATED APPLICATION

This application claims priority to and the benefit of Korean Patent Application No. 10-2007-0067076, filed on Jul. 4, 2007, in the Korean Intellectual Property Office, the entire content of which is incorporated herein by reference.

BACKGROUND

1. Field of the Invention

The present invention relates to an organic light emitting display and a manufacturing method thereof, and, more particularly, to an organic light emitting display and a manufacturing method thereof capable of improving image quality of the organic light emitting display.

2. Description of the Related Art

Various flat panel display devices, having less weight and volume than a cathode ray tube, have been developed. A flat panel display device can be a liquid crystal display (LCD), a field emission display (FED), a plasma display panel (PDP), an organic light emitting display (OLED), etc.

An organic light emitting display is a flat panel display device that displays an image using an organic light emitting diode (OLED) to generate light by utilizing the recombination of electrons-holes.

FIG. 1 is a circuit view showing a pixel adopted in an organic light emitting display. Referring to FIG. 1, the pixel includes a first transistor T1, a second transistor T2, a capacitor Cst, and an organic light emitting diode OLED.

The source of the first transistor T1 is coupled to a first power supply ELVDD, the drain thereof is coupled to an organic light emitting diode OLED, and the gate thereof is coupled to a node N1. The source of the second transistor T2 is coupled to a data line Dm, the drain thereof is coupled to the node N1, and the gate thereof is coupled to a scan line Sn.

The first electrode of the capacitor Cst is coupled to the first power supply ELVDD and the second electrode thereof is coupled to the node N1.

Also, the organic light emitting diode OLED includes an anode electrode, a cathode electrode and a light emitting layer, wherein the anode electrode is coupled to the drain of the first transistor T1 and the cathode electrode is coupled to a second power supply ELVSS.

If current flows from the anode electrode of the organic light emitting diode OLED to the cathode electrode thereof, the light emitting layer emits light corresponding to the amount of the flowing current. The equation 1 represents current flowing into the drain of the first transistor T1.

$$I_d = \frac{\beta}{2}(ELVDD - Vdata - Vth)^2 \qquad \text{Equation 1}$$

Here, $I_d$ represents the current flowing into the drain of the first transistor T1, Vdata represents the voltage of a data signal, ELVDD represents the voltage of the first power supply transferred to the source of the first transistor, Vth represents the threshold voltage of the first transistor T1, and β represents a constant.

Therefore, the current flowing into the drain of the first transistor T1 flows corresponding to the voltage of the data signal and the threshold voltage of the first transistor T1.

However, a difference for the threshold voltage of the first transistor T1 occurs in a process for manufacturing an organic light emitting display, thereby causing unevenness of brightness between pixels.

SUMMARY OF THE INVENTION

Aspects of embodiments of the present invention are directed toward an organic light emitting display and a manufacturing method thereof, capable of improving image quality by reducing unevenness of brightness.

An embodiment of the present invention provides a pixel including: an organic light emitting diode for emitting light in accordance with a received driving current; a first transistor including a gate for receiving a voltage corresponding to a data signal, the first transistor being for transferring the driving current in a direction from a source of the first transistor to a drain of the first transistor; a second transistor for transferring the data signal in accordance with a scan signal; a first capacitor for storing a voltage corresponding to the data signal and for applying the voltage corresponding to the data signal to the gate of the first transistor; and a second capacitor for controlling the voltage stored in the first capacitor, wherein an outer portion of the first capacitor has a plurality of bents.

Another embodiment of the present invention provides an organic light emitting display including: a substrate; a poly silicon layer on the substrate and being active layers for a plurality of thin film transistors and first electrodes of first and second capacitors; and a metal layer on the poly silicon layer and being a scan line, a gate electrode of at least one of the thin film transistors and second electrodes of the first and second capacitors, wherein an outer portion of the poly silicon layer corresponding to the first electrode of the first capacitor has a plurality of bents.

Another embodiment of the present invention provides a manufacturing method of an organic light emitting display including the steps of: depositing and etching a poly silicon layer such that an outer portion of a portion of the poly silicon layer has a plurality of bents; and depositing and etching a metal layer on the poly silicon layer such that an outer portion of the metal layer has a plurality of bents.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
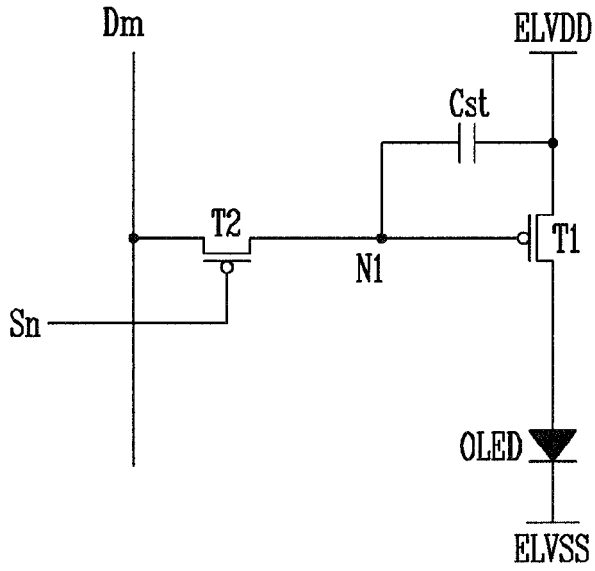
FIG. 1 (PRIOR ART)
FIG. 1 is a circuit view schematically showing a pixel adopted in an organic light emitting display.

In the following detailed description, only certain exemplary embodiments of the present invention are shown and described, by way of illustration. As those skilled in the art would recognize, the invention may be embodied in many different forms and should not be construed as being limited to the embodiments set forth herein. Also, when a first element is referred to as being "on" a second element, it can be directly on the second element or be indirectly on the second element with one or more intervening elements interposed therebetween. In addition, when a first element is described as being "coupled to" a second element, the first element may be not only directly coupled to the second element but may also be indirectly coupled to the second element via one or more intervening elements. Further, elements that are not essential to the complete understanding of the invention may be omitted for clarity. Like reference numerals designate like elements throughout the specification.

Figure 2:
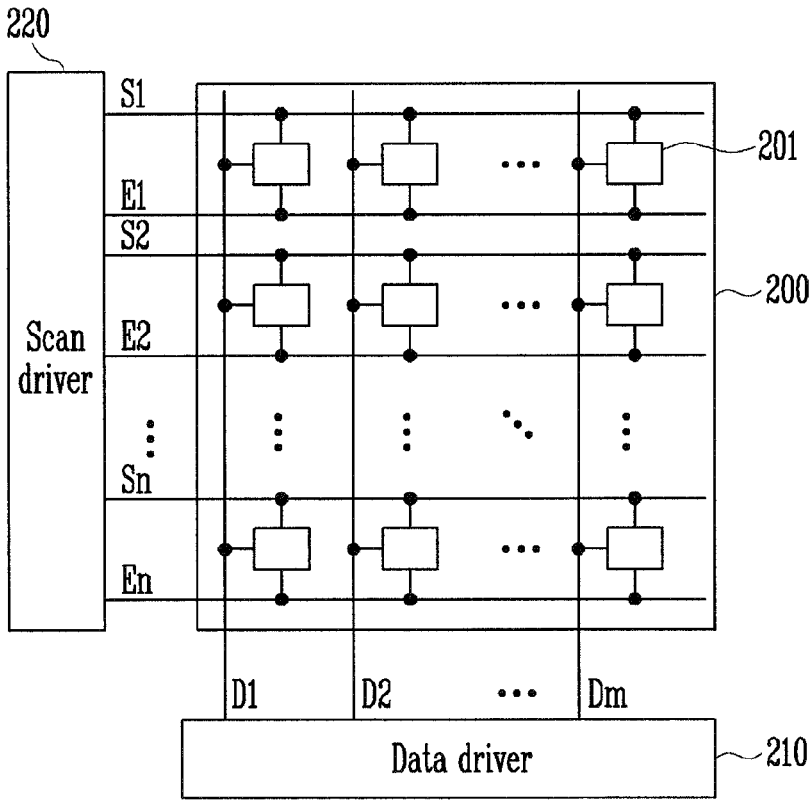
FIG. 2 is a structure view schematically showing a structure of an organic light emitting display according to an embodiment of the present invention.

FIG. 2 is a structure view schematically showing a structure of an organic light emitting display according to an embodiment of the present invention. Referring to FIG. 2, a display region (or pixel unit) 200 is arranged with a plurality of pixels 201, wherein each pixel 201 includes an organic light emitting diode for emitting light corresponding to the flow of current. Also, n scan lines S1, S2, . . . Sn-1 and Sn (for transferring scan signals) and n light emitting control lines E1, E2, . . . , E1 and En are arranged in a row direction, and m data lines D1, D2, . . . Dm-1 and Dm (for transferring data signals) are arranged in a column direction. In addition, the display region 200 is driven by receiving a first power of a first power supply ELVDD and a second power of a second power supply ELVSS. Further, after the pixel 201 is initialized by receiving initialization voltage Vinit by utilizing the scan signal of a previous scan line (e.g., Sn-1), the organic light emitting diode is light-emitted by utilizing the scan signal of a current scan line (e.g., Sn), the data signal, the first power of the first power supply ELVDD and the second power of the second power supply ELVSS, to thereby display an image.

A data driver 210, which is utilized for applying the data signal to the display region 200, generates the data signal by receiving video data with red, blue, and green components. Also, the data driver 210 is coupled to the data lines D1, D2, . . . , Dm-1, and Dm of the display region 200 to apply the generated data signal to the display region 200.

A scan driver 220 is utilized for applying the scan signal to the display region 200. The scan driver 220 is coupled to the scan lines S1, S2, . . . Sn-1, and Sn and the light emitting control lines E1, E2, . . . E1, and En to transfer the scan signal and the light emitting control signal to the display region 200. The data signal output from the data driver 210 is transferred to the pixel 201 to which the scan signal is also transferred, and current corresponding to the data signal flows into the pixel 201 to which the light emitting control signal is transferred so that light is emitted.

Figure 3:
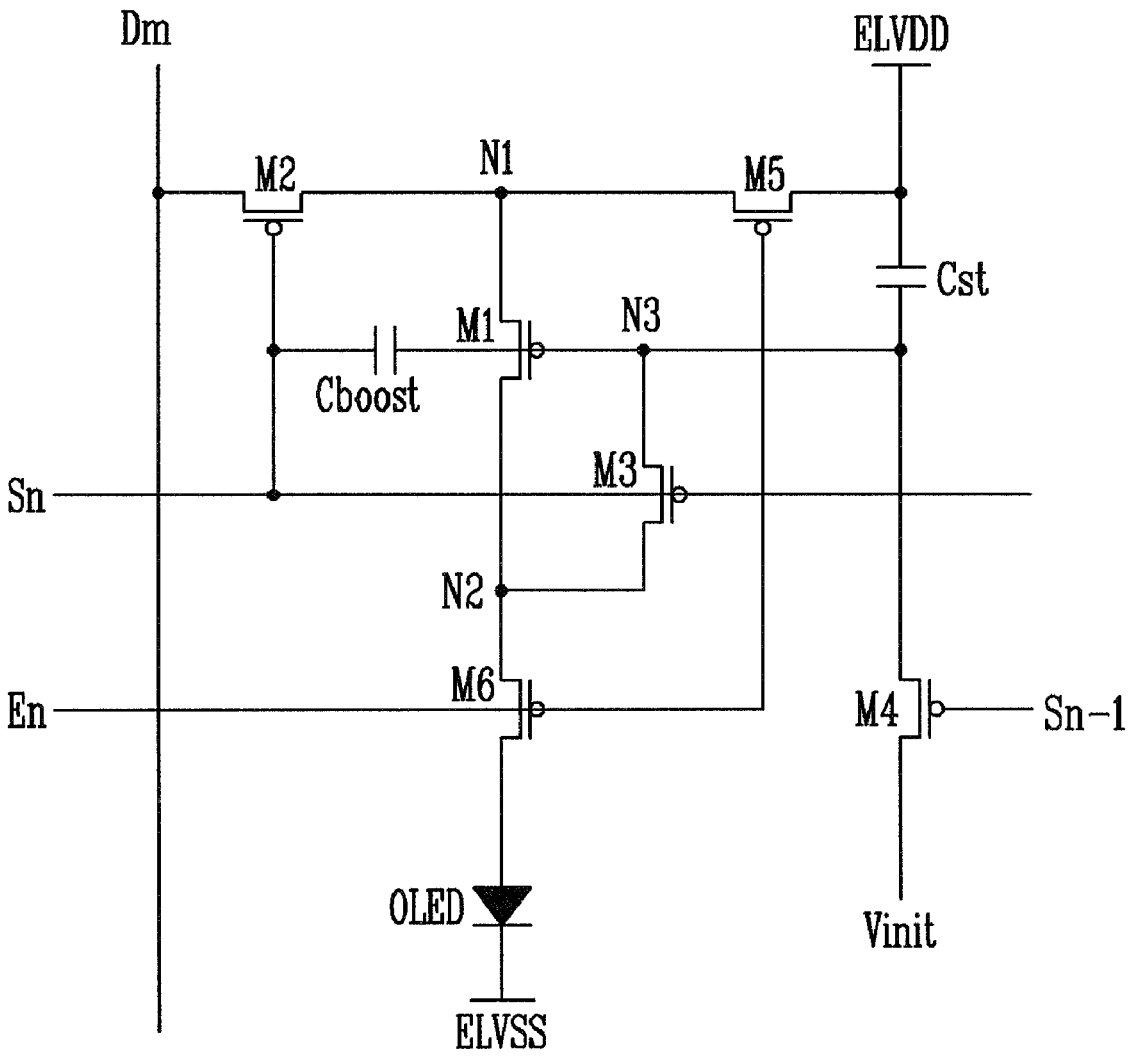
FIG. 3 is a circuit view schematically showing a first embodiment of a pixel adopted in a display region shown in FIG. 2.
Figure 4:
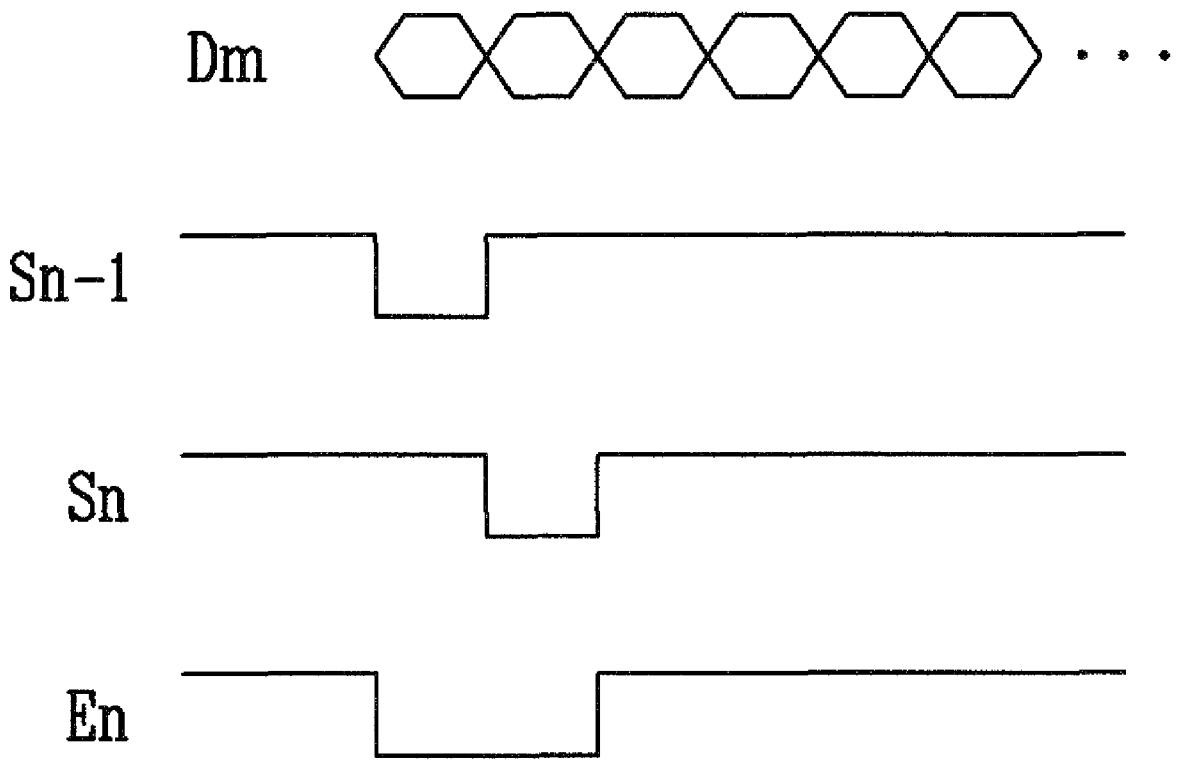
FIG. 4 is a signal view schematically showing a signal transferred into the pixel of FIG. 3.

FIG. 3 is a circuit view schematically showing a first embodiment of a pixel adopted in the display region shown in FIG. 2, and FIG. 4 is a signal view schematically showing a signal transferred into the pixel of FIG. 3. Referring to FIGS. 3 and 4, the pixel includes a first transistor M1, a second transistor M2, a third transistor M3, a fourth transistor M4, a fifth transistor M5, a sixth transistor M6, a first capacitor Cst, a second capacitor Cboost, and an organic light emitting diode OLED.

The source of the first transistor M1 is coupled to a first node N1, the drain thereof is coupled to a second node N2, and the gate thereof is coupled to a third node N3. The first transistor M1 controls the amount of current flowing in a direction from the first node N1 to the second node N2 corresponding to the voltage of the gate of the first transistor M1.

The source of the second transistor M2 is coupled to a data line Dm, the drain thereof is coupled to the first node N1, and the gate thereof is coupled to a scan line Sn. The second transistor M2 performs turn-on and turn-off operations by utilizing a scan signal sn transferred through the scan line Sn so that the data signal can selectively be transferred to the first node N1.

The source of the third transistor M3 is coupled to the second node N2, the drain thereof is coupled to the third node N3, and the gate thereof is coupled to the scan line Sn. The third transistor M3 performs turn-on and turn-off operations by utilizing the scan signal sn to selectively form the same voltage on the gate and the drain of the first transistor M1 so that the first transistor M1 is diode-connected.

The source of the fourth transistor M4 is coupled to an initialization power supply line Vinit for transferring initialization voltage, the drain thereof is coupled to the third node N3, and the gate thereof is coupled to a previous scan line Sn-1. The fourth transistor M4 performs turn-on and turn-off operations by utilizing a previous scan signal sn-1 transferred through the previous scan line Sn-1 to initialize the first capacitor Cst.

The source of the fifth transistor M5 is coupled to the first node N1, the drain thereof is coupled to the first power supply line ELVDD for transferring a first power, and the gate thereof is coupled to a light emitting control line En. The fifth transistor M5 performs turn-on and turn-off operations by utilizing a light emitting control signal received through the light emitting control line En so that the first power transferred through the first power supply line ELVDD is selectively transferred to the first node N1.

The source of the sixth transistor M6 is coupled to the second node N2, the drain thereof is coupled to an anode electrode of the organic light emitting diode OLED, and the gate thereof is coupled to the light emitting control line En. The sixth transistor M6 allows the current flowing in a direction from the first node N1 to the second node N2 to be selectively transferred to the organic light emitting diode OLED by utilizing the light emitting control signal transferred through the light emitting control line En.

The first electrode of the first capacitor Cst is coupled to the third node N3 and the second electrode thereof is coupled to the first power supply line ELVDD to maintain the voltage of the third node N3.

The first electrode of the second capacitor Cboost is coupled to the gate of the second transistor M2 and the second electrode thereof is coupled to the third node N3. If the scan signal sn transferred through the scan line Sn changes to a high state from a low state, the voltage of the first electrode of the second capacitor Cboost becomes high and thus, the voltage of the third node N3 also becomes high.

The operation of the pixel of FIG. 3 will be described in more detail with reference to FIG. 4. First, the fourth transistor M4 is in an on-state by utilizing the previous scan signal sn-1 transferred through the previous scan line Sn-1 so that the first capacitor Cst is initialized by utilizing the initialization signal Vinit. Then, when the second transistor M2 and the third transistor M3 are in on-states by utilizing the scan signal sn transferred through the scan line Sn, voltage corresponding to the equation 2 is transferred to the first electrode of the first capacitor Cst.

$$V_{data}-V_{th} \qquad \text{Equation 2}$$

Here, $V_{data}$ represents the voltage of the data signal, $V_{th}$ represents the threshold voltage of the first transistor M1. Therefore, voltage corresponding to the equation 2 is applied to the gate of the first transistor M1. At this time, current flowing in a direction from the source of the first transistor M1 to the drain thereof corresponds to the equation 3 below.

$$I_d = \frac{\beta}{2}(V_{gs} - Vth)^2 = \frac{\beta}{2}(Vth - vdata + ELVDD - Vth)^2 = \frac{\beta}{2}(ELVDD - vdata)^2 \quad \text{Equation 3}$$

Here, $I_d$ represents current flowing in the direction from the source of the first transistor M1 to the drain thereof, β represents a constant, $V_{th}$ represents the threshold voltage of the first transistor M1, ELVDD represents pixel voltage applied to the source of the first transistor M1, and Vdata represents the voltage of the data signal. Accordingly, as can be seen in Equation 2, the unevenness of the threshold voltage of the first transistor M1 can be compensated.

Also, the first capacitor Cst and the second capacitor Cboost are coupled so that when the scan signal sn transferred to the second capacitor Cboost (coupled to the scan line Sn) changes to a high state from a low state, the voltage of the third node N3 becomes high. Accordingly, the gate voltage of the first transistor M1 becomes high so that the pixel can display black (or a black image or a black color).

The organic light emitting diode OLED includes a light emitting layer, an anode electrode and a cathode electrode. If current flows to the light emitting layer, the organic light emitting diode accordingly emits light. The anode electrode of the organic light emitting diode is coupled to the drain of the sixth transistor M6, and the cathode electrode thereof is coupled to the second power supply (or the second power supply line) ELVSS.

Figure 5:
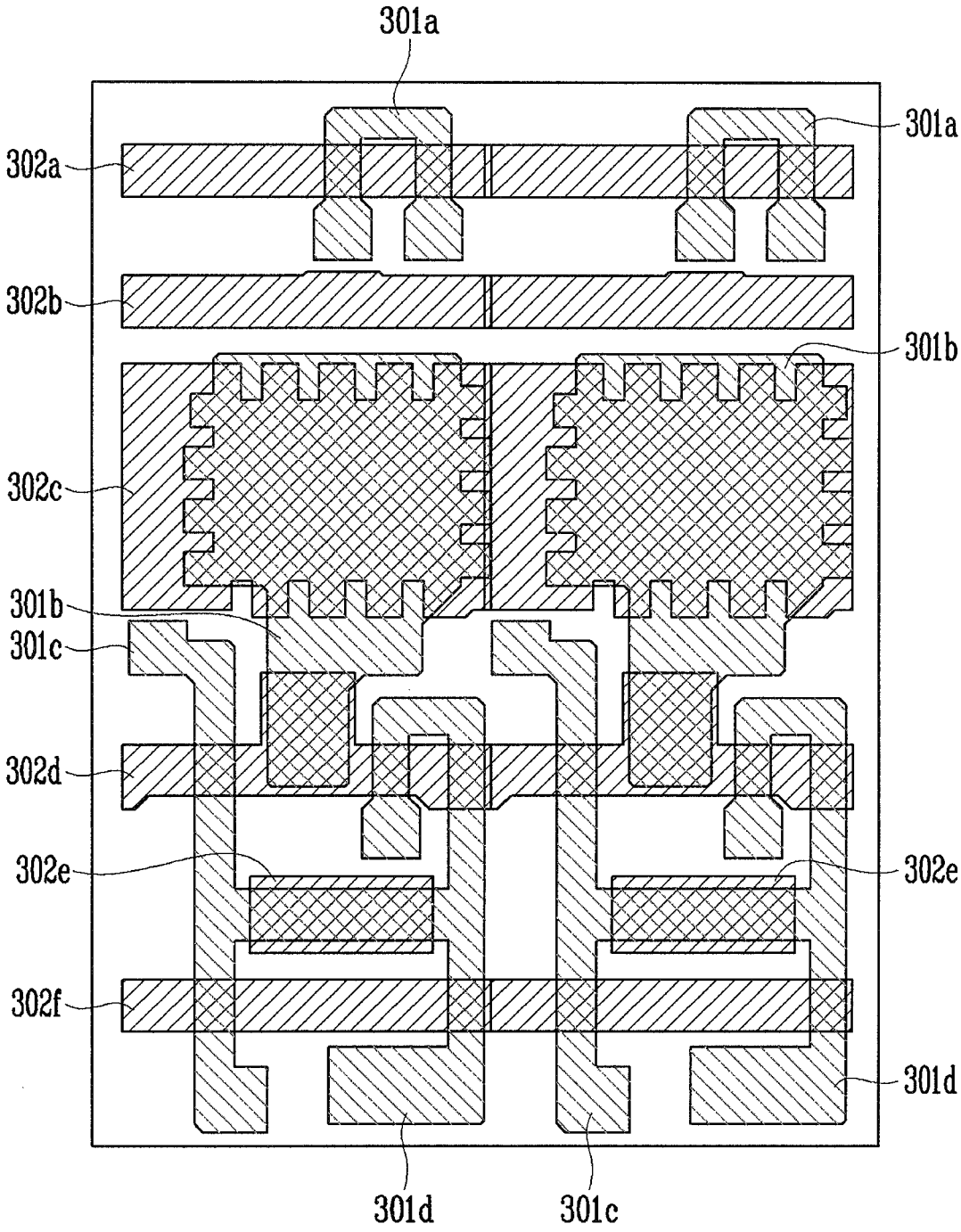
FIG. 5 is a lay-out view schematically showing a structure of the pixel of FIG. 3.
Figure 6:
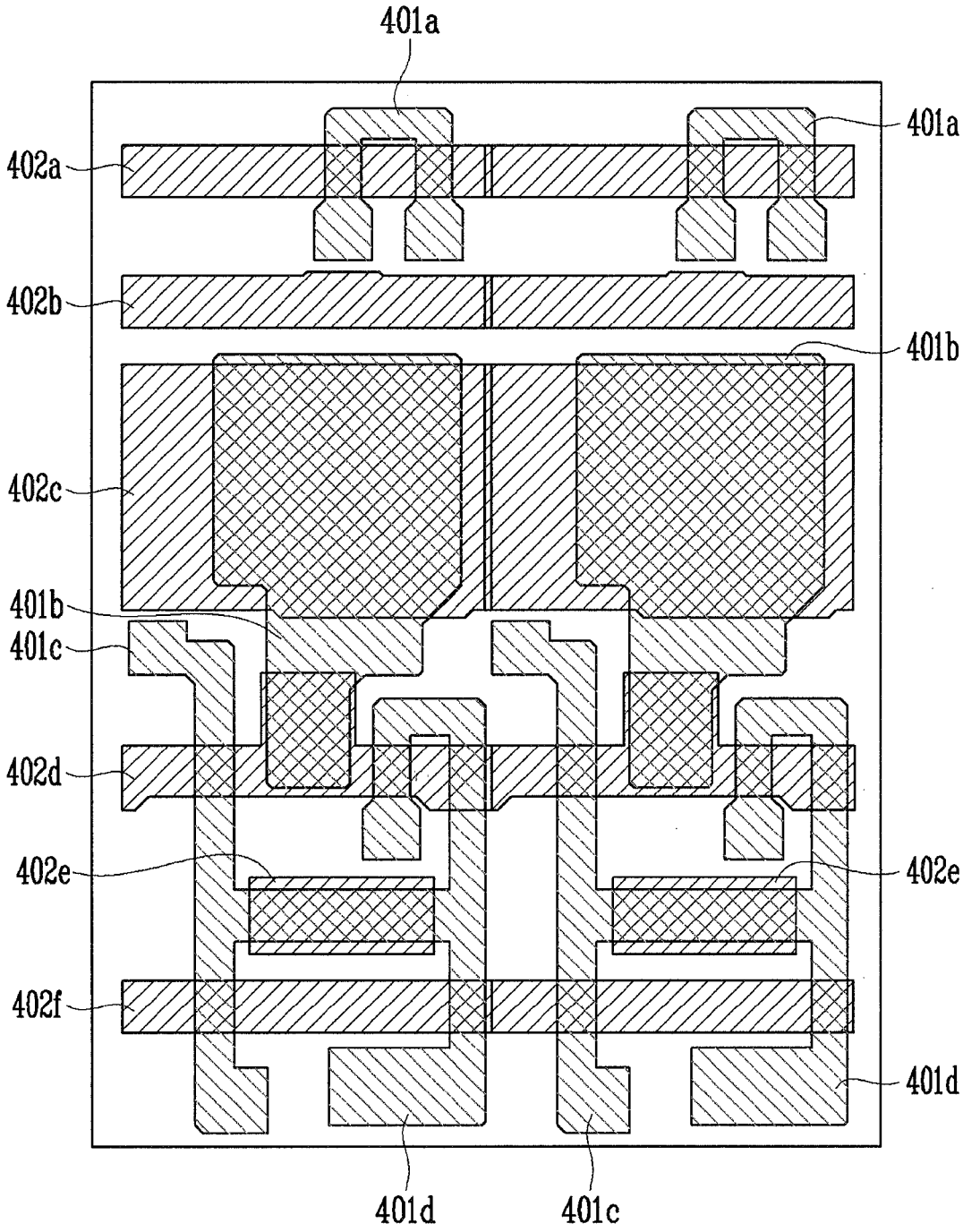
FIG. 6 is a lay-out view schematically showing a structure of a commonly used pixel.

FIG. 5 is a lay-out view schematically showing a structure of the pixel of FIG. 3, and FIG. 6 is a lay-out view schematically showing a structure of a commonly used pixel. Referring to FIGS. 5 and 6, poly silicon layers 301*a*, 301*b*, 301*c*, and 301*d* or 401*a*, 401*b*, 401*c*, and 401*d* are firstly formed on a substrate, and the poly silicon layers are etched into desired shapes (or predetermined shapes) in an etching process so that they become active layers 301*a*, 301*c*, and 301*d* or 401*a*, 401*c*, and 401*d* of transistors, and first electrodes 301*b* or 401*b* of capacitors, etc. Also, metal layers 302*a*, 302*b*, 302*c*, 302*d*, 302*e*, and 302*f* or 402*a*, 402*b*, 402*c*, 402*d*, 402*e*, and 402*f* are formed thereon to form a scan line (e.g., 302*a* or 402*a*), a light emitting control line, a gate electrode of the transistor, and second electrodes 302*c*, 302*e* or 402*c*, 402*e* of the capacitors, etc.

Here, the first electrodes of the capacitors formed by utilizing the poly silicon layers become the first electrodes of the first and second capacitors Cst and Cboost in FIG. 3, and the second electrodes of the capacitor formed by utilizing the metal layers become the second electrodes of the first and second capacitors Cst and Cboost.

In more detail and as shown in FIG. 5, the poly silicon layer 301*b* is utilized to form the first electrode of the first capacitor Cst, and the metal layer 302*c* is utilized to form the second electrode of the first capacitor Cst. Here, the poly silicon layer 301*b* and the metal layer 302*c* are formed with bents at their outer portions so that the area sizes of the first and second electrodes of the first capacitor Cst can be small, thereby reducing the capacitance of the first capacitor Cst. The form of bents is not limited to the form as shown in FIG. 5, and any suitable structural form for allowing an etched area to be more widely formed, such as a saw-tooth form, etc. can be used.

In FIG. 6, the first and second electrodes of the first capacitor Cst are formed to not have bents at the outer portion of the first capacitor Cst. By contrast, in the embodiment of present invention as shown in FIG. 5, bents are formed, and the reason why the bents are formed on the first and second electrodes of the first capacitor Cst is to lower the difference between values of the design kickback voltage and the actual kickback voltage generated in actual (or real manufacturing) processes.

The kickback voltage corresponds to the equation 4.

$$\Delta V = \frac{C_{boost}}{C_{st} + C_{boost}} V \quad \text{Equation 4}$$

Here, ΔV represents the kickback voltage, Cst represents the capacitance of the first capacitor, Cboost represents the capacitance of the second capacitor, and V represents the voltage of the scan signal. The value of the design kickback voltage of the first and second capacitors is shown in Table 1.

TABLE 1

| | Area | Capacitance (pF) | Ratio (Cst/Cboost) | Cboost/ (Cst + Cboost) | Kickback voltage |
|---|---|---|---|---|---|
| Cst | 1047 | 0.359 | 6.377 | 0.136 | 1.654 |
| Cboost | 164 | 0.0563 | | | |

If the first and second capacitors designed as above are formed as shown in FIG. 6, they have sizes as shown in Table 2.

TABLE 2

| | Area | Capacitance (pF) | Ratio (Cst/Cboost) | Cboost/ (Cst + Cboost) | Kickback voltage |
|---|---|---|---|---|---|
| Cst | 993 | 0.3405 | 6.893 | 0.127 | 1.546 |
| Cboost | 144 | 0.0494 | | | |

In other words, in a process forming the first and second capacitors, the sizes of the first and second capacitors are represented to be smaller than the values of design. Also, the size of the second capacitor is smaller than that of the first capacitor so that the first capacitor is proportionally reduced less in amount than that of the second capacitor. Therefore, a ratio of the capacitance of the second capacitor in the sum of the capacitances of the first and second capacitors is smaller in the actual (or real) process than the value of the design, so that there is a large difference between the values of the design kickback voltage and the actual kickback voltage.

Therefore, as shown in FIG. 5, the outer portion of the poly silicon layer formed as the first electrode of the first capacitor is formed to have bents, and the outer portion of the metal layer formed as the second electrode of the first capacitor is formed to have bents so that the first capacitor is formed. As shown in FIG. 5, if the outer portions of the poly silicon layer and the metal layer are formed to have bents, the area amount that the poly silicon layer and the metal layer are reduced so that the capacitance of the first capacitance becomes smaller, as shown in Table 3.

TABLE 3

| | Area | Capacitance (pF) | Ratio (Cst/Cboost) | Cboost/ (Cst + Cboost) | Kickback voltage |
|---|---|---|---|---|---|
| Cst | 938 | 0.319 | 6.457 | 0.134 | 1.635 |
| Cboost | 114 | 0.0494 | | | |

Therefore, the ratio of the capacitance of the second capacitor in the sum of the capacitances of the first and second capacitors becomes larger than that shown in Table 2. Reviewing the differences of the kickback voltages, the kickback voltage shown in Table 3 has a size similar to that shown in Table 1, thereby making it possible to reduce the deterioration of image quality due to the difference of values of the design kickback voltage and the actual kickback voltage.

Figure 7:
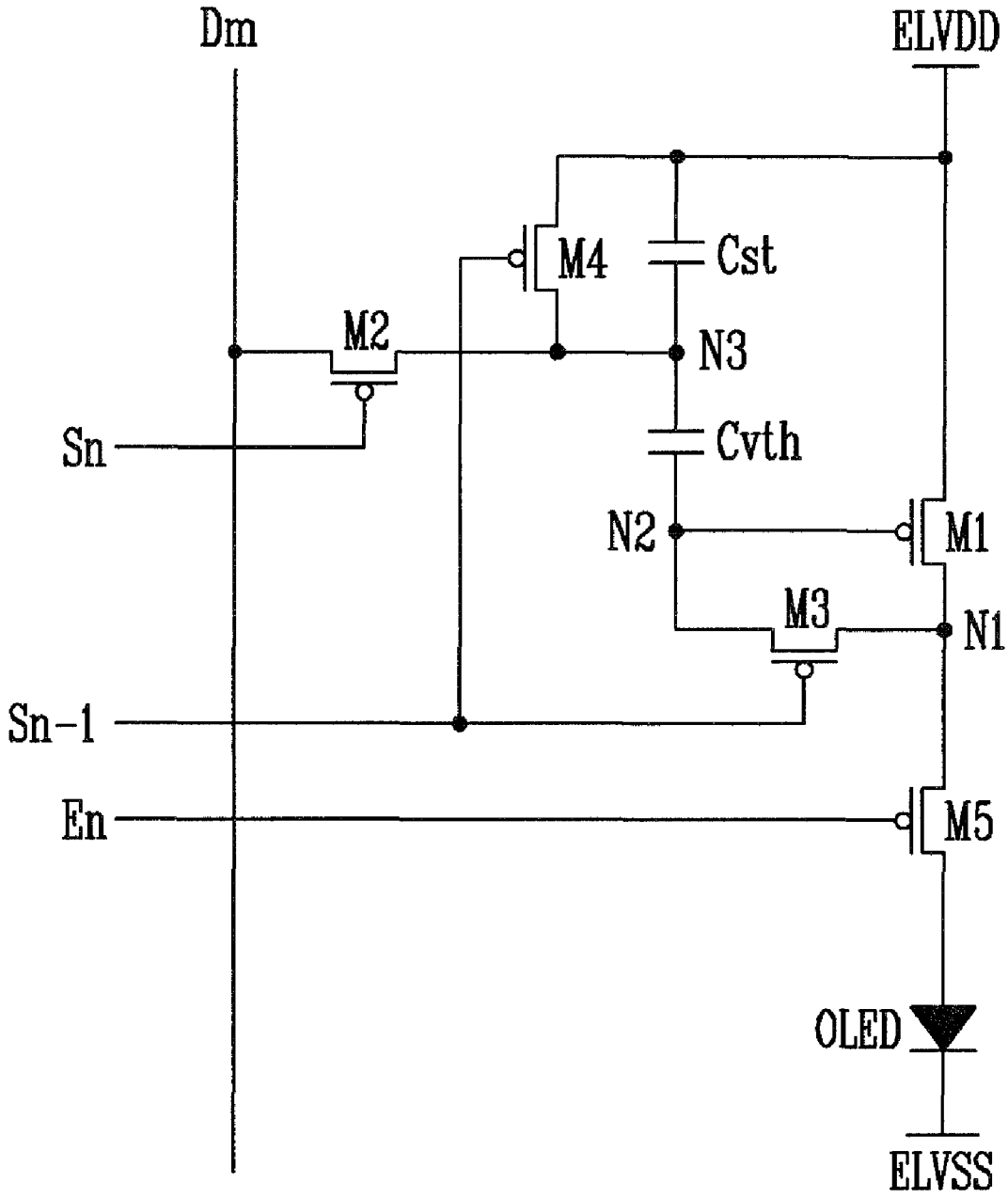
FIG. 7 is a circuit view schematically showing a second embodiment of the pixel adopted in the display region shown in FIG. 2.

FIG. 7 is a circuit view showing a second embodiment of the pixel adopted in the display region shown in FIG. 2. Referring to FIG. 7, the pixel includes first to fifth transistors M1 to M5, a first capacitor Cst, a second capacitor Cvth, and an organic light emitting diode OLED, and operates by receiving a signal as shown in FIG. 4.

The first to fifth transistors M1 to M5 includes sources, drains, and gates, and are implemented as transistors in PMOS forms. The sources and drains of each of the transistors do not have a physical difference so that they can be referred to as a first electrode and a second electrode. Also, each of the first capacitor Cst and the second capacitor Cvth includes a first electrode and a second electrode.

The source of the first transistor M1 receives pixel power through a pixel power supply line ELVDD, the drain thereof is coupled to a first node N1, and the gate thereof is coupled to a second node N2. The amount of current flowing in a direction from the source to the drain is determined according to voltage applied to the gate of the first transistor M1.

The source of the second transistor M2 is coupled to a data line Dm, the drain thereof is coupled to a third node N3, the gate thereof is coupled to a scan line Sn. The second transistor M2 performs turn-on and turn-off operations by utilizing a scan signal sn transferred through the scan line Sn to selectively transfer a data signal to the third node N3.

The source of the third transistor M3 is coupled to the first node N1, the drain thereof is coupled to the second node N2, and the gate thereof is coupled to a previous scan line Sn-1. The third transistor M3 performs turn-on and turn-off operations by utilizing a previous scan signal sn-1 transferred through the previous scan line Sn-1 to selectively make the potentials of the first node N1 and the second node N2 equal so that the first transistor M1 is selectively diode-connected.

The source of the fourth transistor M4 is coupled to the pixel power supply line ELVDD, the drain thereof is coupled to the third node N3, and the gate thereof is coupled to the previous scan line Sn-1. The fourth transistor M4 selectively transfers pixel power of the pixel power line ELVDD to the third node N3 according to the previous scan signal sn-1.

The source of the fifth transistor M5 is coupled to the first node N1, the drain thereof is coupled to an organic light emitting diode OLED, and the gate thereof is coupled to a light emitting control line En. The fifth transistor M5 performs turn-on and turn-off operations by utilizing a light emitting control signal received through the light emitting control line En to allow current flowing to the first node N1 to flow to the organic light emitting diode OLED.

The first electrode of the first capacitor Cst is coupled to the pixel power supply line ELVDD, and the second electrode thereof is coupled to the third node N3. The first capacitor Cst selectively stores a voltage having a value that is as much as voltage difference between the pixel power supply line ELVDD and the third node N3 by utilizing the fourth transistor M4.

The first electrode of the second capacitor Cvth is coupled to the third node N3, and the second electrode thereof is coupled to the second node N2. Accordingly, the second capacitor Cvth stores voltage having a voltage that is as much as the voltage difference between the third node N3 and the second node N2.

Therefore, when the third transistor M3 and the fourth transistor M4 are in on-states by utilizing the previous scan signal sn-1 transferred to the previous scan line Sn-1, the first transistor M1 is diode-connected so that voltage corresponding to the threshold voltage of the first transistor M1 is transferred to the first electrode of the second capacitor Cvth and the pixel power ELVDD is transferred to the second electrode of the second capacitor Cvth. Accordingly, the second capacitor Cvth stores voltage corresponding to the threshold voltage of the first transistor M1. Then, when the scan signal sn is received through the scan line Sn, the second transistor M2 is in an on-state so that a data signal is transferred to the third node N3. As a result, the voltage of the third node N3 is changed to the voltage of the pixel power supply ELVDD, and voltage corresponding to the data signal is stored in the first capacitor Cst. Therefore, the voltage corresponding to the data signal and the threshold voltage is stored in the second node N2, and driving current with a compensated threshold voltage is generated and flows in a direction from the source of the first transistor M1 to the drain thereof. Accordingly, the unevenness of brightness due to the difference of the threshold voltages of transistors can be compensated.

Even in the pixel constructed as above, the design value of the capacitance difference between the first capacitor Cst and the second capacitor Cvth may still be different from the actual (or real) value in an actual (or real manufacturing) process. As such, in order to allow the capacitance of the first capacitor Cst to become smaller, the outer portions of the first electrode and second electrode of the first capacitor Cst can be formed to have bents.

In view of the foregoing, with the organic light emitting display and the manufacturing method thereof according to embodiments of the present invention, the deterioration of image quality due to the unevenness of the threshold voltages can be prevented (or reduced), and the deterioration of image quality due to the difference in the design and actual values of the capacitance differences (or capacitance ratios or kickback voltages) between the capacitors caused by an error generated in the actual (or real manufacturing) process can be prevented (or reduced), thereby making it possible to further improve the image quality.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel comprising:

an organic light emitting diode for emitting light in accordance with a received driving current;

a first transistor comprising a gate for receiving a voltage corresponding to a data signal, the first transistor being for transferring the driving current in a direction from a source of the first transistor to a drain of the first transistor;

a second transistor for transferring the data signal in accordance with a scan signal;

a first capacitor for storing a voltage corresponding to the data signal and for applying the voltage corresponding to the data signal to the gate of the first transistor; and a second capacitor for controlling the voltage stored in the first capacitor, wherein an outer portion of the first capacitor has a plurality of bents forming a plurality of protruding portions and a plurality of receding portions therebetween.

2. The pixel as claimed in claim 1, further comprising a third transistor coupled to the gate of the first transistor and the drain of the first transistor to short-circuit the gate of the first transistor and the drain of the first transistor with each other in accordance with the scan signal.

3. The pixel as claimed in claim 2, further comprising a fourth transistor coupled to the first capacitor and for transferring an initialization signal to the first capacitor.

4. The pixel as claimed in claim 3, wherein the fourth transistor performs a switching operation in accordance with a scan signal transferred through a previous scan line.

5. The pixel as claimed in claim 3, further comprising:

a fifth transistor for transferring a first power of a first power supply to the first transistor in accordance with a light emitting control signal; and a sixth transistor for transferring the driving current generated from the first transistor to the organic light emitting diode in accordance with the light emitting control signal.

6. The pixel as claimed in claim 1, further comprising:

a third transistor for transferring a first power of a first power supply to the first transistor in accordance with a light emitting control signal; and a fourth transistor for transferring the driving current generated from the first transistor to the organic light emitting diode in accordance with the light emitting control signal.

7. The pixel as claimed in claim 1, further comprising a third transistor coupled to the first capacitor and for transferring an initialization signal to the first capacitor.

8. The pixel as claimed in claim 1, comprising:

a third transistor for performing a switching operation in accordance with a scan signal transferred through a previous scan line and for transferring a voltage corresponding to a threshold voltage of the first transistor to the second capacitor;

a fourth transistor for performing a switching operation in accordance with a scan signal transferred through a previous scan line and for transferring a pixel voltage to the second capacitor; and a fifth transistor for performing a switching operation in accordance with a light emitting control signal to transfer the driving current transferred from the first transistor to the organic light emitting diode.

9. An organic light emitting display comprising:

a substrate;

a poly silicon layer on the substrate and being active layers for a plurality of thin film transistors and first electrodes of first and second capacitors; and a metal layer on the poly silicon layer and being a scan line, a gate electrode of at least one of the thin film transistors and second electrodes of the first and second capacitors, wherein an outer portion of the poly silicon layer corresponding to the first electrode of the first capacitor has a plurality of bents foaming a plurality of protruding portions and a plurality of receding portions therebetween.

10. The organic light emitting display as claimed in claim 9, wherein an outer portion of the metal layer corresponding to the second electrode of the first capacitor has a plurality of bents.

11. The organic light emitting display as claimed in claim 10, further comprising an organic light emitting diode for emitting light in accordance with a received driving current, wherein the plurality of thin film transistors comprise:

a first transistor comprising a gate for receiving a voltage corresponding to a data signal, the first transistor being for transferring the driving current in a direction from a source of the first transistor to a drain of the first transistor; and a second transistor for transferring the data signal in accordance with a scan signal, and wherein the first capacitor is for storing a voltage corresponding to the data signal and for applying the voltage corresponding to the data signal to the gate of the first transistor, and wherein the second capacitor is for controlling the voltage stored in the first capacitor.

12. The organic light emitting display as claimed in claim 11, wherein the plurality of thin film transistors further comprises a third transistor coupled to the gate of the first transistor and the drain of the first transistor to short-circuit the gate of the first transistor and the drain of the first transistor with each other in accordance with the scan signal.

13. The organic light emitting display as claimed in claim 12, wherein the plurality of thin film transistors further comprises a fourth transistor coupled to the first capacitor and for transferring an initialization signal to the first capacitor.

14. The organic light emitting display as claimed in claim 13, wherein the fourth transistor performs a switching operation in accordance with a scan signal transferred through a previous scan line.

15. The organic light emitting display as claimed in claim 13, wherein the plurality of thin film transistors further comprises:

a fifth transistor for transferring a first power of a first power supply to the first transistor in accordance with a light emitting control signal; and a sixth transistor for transferring the driving current generated from the first transistor to the organic light emitting diode in accordance with the light emitting control signal.

16. The organic light emitting display as claimed in claim 11, wherein the plurality of thin film transistors further comprises:

a third transistor for performing a switching operation in accordance with a scan signal transferred through a previous scan line and for transferring a voltage corresponding to a threshold voltage of the first transistor to the second capacitor;

a fourth transistor for performing a switching operation in accordance with a scan signal transferred through a previous scan line and for transferring a pixel voltage to the second capacitor; and a fifth transistor for performing a switching operation in accordance with a light emitting control signal to transfer the driving current transferred from the first transistor to the organic light emitting diode.

17. A method of manufacturing an organic light emitting display comprising: depositing and etching a poly silicon layer such that an outer portion of a portion of the poly silicon layer has a plurality of bents forming a plurality of protruding portions and a plurality of receding portions there between; depositing and etching a metal layer on the poly silicon layer such that an outer portion of the metal layer has a plurality of bents; forming first and second capacitors by utilizing the poly silicon layer and the metal layer; forming a first electrode of the first capacitor by utilizing the outer portion of the poly silicon layer; and forming a second electrode of the first capacitor by utilizing the outer portion of the metal layer.

18. The method of manufacturing an organic light emitting display as claimed in claim 17, wherein the poly silicon layer and the metal layer of the first capacitor are etched more in area than that of the second capacitor is etched by utilizing the plurality of bents of the outer portion of the poly silicon layer and the plurality of bents of the outer portion of the metal layer.

19. The method of manufacturing an organic light emitting display as claimed in claim 17, wherein the poly silicon layer and the metal layer are etched such that an actual kickback voltage of the first capacitor and the second capacitor is increased by utilizing the plurality of bents of the outer portion of the poly silicon layer and the plurality of bents of the outer portion of the metal layer.

* * * * *

UNITED STATES PATENT AND TRADEMARK OFFICE

CERTIFICATE OF CORRECTION

PATENT NO. : 8,362,983 B2
APPLICATION NO. : 12/107164
DATED : January 29, 2013
INVENTOR(S) : Won-Kyu Kwak et al.

It is certified that error appears in the above-identified patent and that said Letters Patent is hereby corrected as shown below:

In the Claims

| | |
|---|---|
| Column 9, Claim 9, line 65 | Delete "foaming"<br>Insert -- forming -- |
| Column 11, Claim 17, line 1 | Delete "there between"<br>Insert -- therebetween -- |

Signed and Sealed this
First Day of July, 2014

Michelle K. Lee

Michelle K. Lee
*Deputy Director of the United States Patent and Trademark Office*